United States Patent [19]

Nakao et al.

[11] 4,050,103

[45] Sept. 27, 1977

[54] URINATING RECEIVER

[75] Inventors: Shinroku Nakao, Yokohama; Yoshiyasu Ishii; Kenshun Ishii, both of Tokyo, all of Japan

[73] Assignee: Combi Co., Ltd., Tokyo, Japan

[21] Appl. No.: 739,378

[22] Filed: Nov. 5, 1976

[30] Foreign Application Priority Data

| | | |
|---|---|---|
| Nov. 10, 1975 | Japan | 50-152823[U] |
| Nov. 10, 1975 | Japan | 50-152824[U] |
| Nov. 10, 1975 | Japan | 50-152825[U] |
| Nov. 21, 1975 | Japan | 50-158134[U] |
| Nov. 27, 1975 | Japan | 50-160601[U] |
| Mar. 10, 1976 | Japan | 51-28240[U] |
| Mar. 10, 1976 | Japan | 51-28241[U] |

[51] Int. Cl.[2] ..... A61G 9/00; A47K 11/12

[52] U.S. Cl. ..... 4/110; 4/112; 128/295

[58] Field of Search ..... 4/110, 112, 113, 142, 4/114, 116; 128/295

[56] References Cited

U.S. PATENT DOCUMENTS

| | | | |
|---|---|---|---|
| 3,000,015 | 9/1961 | Hart | 4/110 |
| 3,174,159 | 3/1965 | Bartoldo | 4/112 |
| 3,227,162 | 1/1966 | Aguirre | 128/295 |
| 3,422,463 | 1/1969 | Lowry | 4/110 |
| 3,512,185 | 5/1970 | Ellis | 4/110 |
| 3,703,731 | 11/1972 | Leiser | 4/110 |
| 3,964,111 | 6/1976 | Packer | 4/110 |

*Primary Examiner*—Henry K. Artis

*Attorney, Agent, or Firm*—Sughrue, Rothwell, Mion, Zinn and Macpeak

[57] ABSTRACT

A urinating device for use by a sick person, an aged person who cannot leave his bed without another person's assistance, or a disabled person comprises a urine storing tank, a urinating receiver, and a urine discharging pipe connected between the storing tank and the receiver. The receiver comprises a body having a front end opened and a rear end closed except for its lower portion, where a pipe for connecting the receiver body to the urine storing tank protrudes, a contact frame made of elastic material and having a base end detachably mounted on the front end of the receiver body and a curved, recessed front end, and contact holding means secured to the receiver body for placing it in contact with the circumferential area of a sexual organ.

12 Claims, 12 Drawing Figures

URINATING RECEIVER

BACKGROUND OF THE INVENTION

This invention relates to urinating devices which a user can employ without another person's assistance while lying in bed, and more paticularly to urinating receivers which may be used by sick persons, aged persons who cannot leave their beds by themselves, or disabled persons.

A chamber pot is most popularly known as a vessel into which a sick person passes his urine. However, conventional chamber pots are disadvantageous in the following respects. Because of its construction a person who cannot leave his bed by himself, or a disabled person, cannot use it without the assistance of another person or a nurse. Even if he can have such assistance, since he must use it frequently, it is troublesome for the nurse to assist him whenever he wants to pass his urine, and he tends to hesitate to ask for assistance. Further, conventional chamber pots are made of a hard material such as glass or synthetic resin. Accordingly, it is difficult for a woman to place it in close contact with the circumferential area for her vagina because its urine receiving opening is relatively large. Furthermore, it is also difficult for a man to place it in close contact with the circumferential area of the base of his penis, which may lead to discomfort due to the leakage of urine and/or may soil the bedding. In addition, the conventional chamber pots are not applicable to a sitting person, or a person who lies on his back or on his side.

In order to overcome the above described difficulties, a urinating device comprising a tank (urine vessel), a hose, and a urine receiving body (receiver) has been proposed, as shown in FIG. 12. This device is advantageous in that a person can pass his urine without the assistance of another person. However, one of the above-described difficulties, namely the problem pertaining to tight body contact, is not solved with the proposed device.

SUMMARY OF THE INVENTION

Accordingly, an object of this invention is to eliminate all of the above-described difficulties in a urinating device. More specifically, an object of the invention is to provide a urinating receiver which eliminates discomfort and contamination of bedding due to urine leakage.

Another object of the invention is to provide a urinating receiver which a person can freely use whether he is sitting down, lying on his back, or lying on his side.

Still another object of the present invention is to provide a urinating receiver for a woman which can be placed in close contact with the circumferential area of her vagina.

A further object of the invention is to provide a urinating receiver for a man into which his penis can be readily inserted, and which can be accurately and tightly placed in contact with the circumferential area of the base of the penis.

Briefly, and in accordance with the present invention, a urinating device for use by a sick person, an aged person who cannot leave his bed without another person's assistance, or a disabled person comprises a urine storing tank, a urinating receiver, and a urine discharging pipe connected between the storing tank and the reciever. The receiver comprises a body having an open front end and a closed rear end except for its lower portion, where a pipe for connecting the receiver body to the urine storing tank protrudes, a contact frame made of elastic material and having a base end detachably mounted on the front end of the receiver body and a curved, recessed front end, and contact holding means secured to the receiver body for placing it in contact with the circumferential area of a sexual organ.

DETAILED DESCRIPTION OF THE PREFERRED EMBODIMENTS

Figure 1:
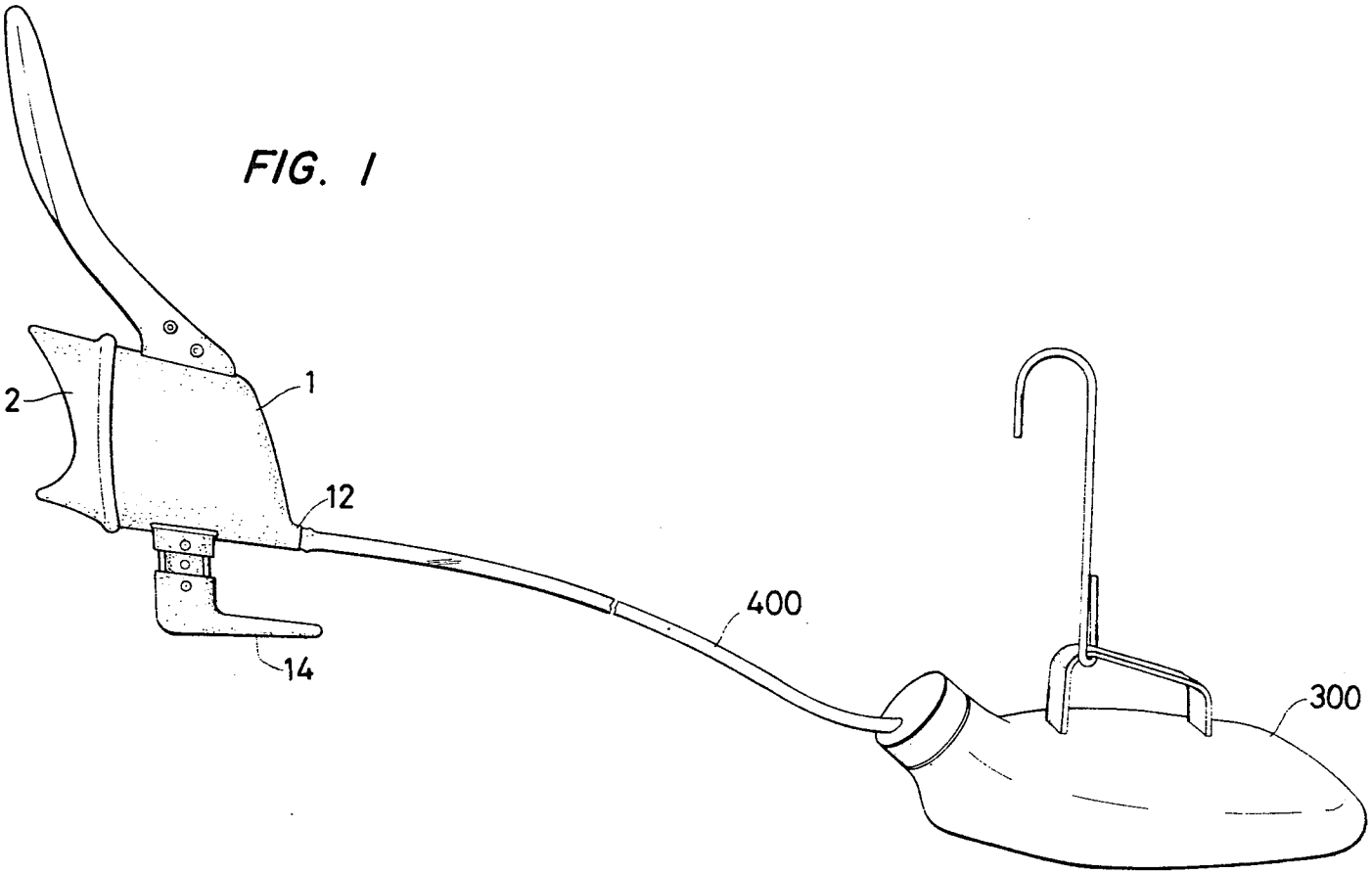
FIG. 1 is a schematic diagram illustrating a urinating device employing a urinating receiver according to this invention.
Figure 2:
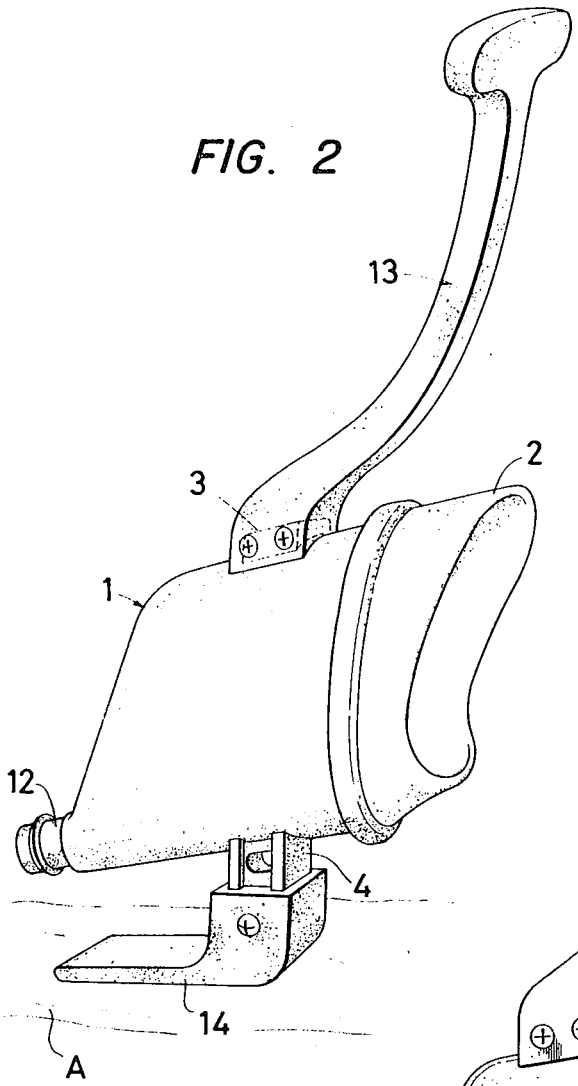
FIG. 2 is a perspective view of a urinating receiver for a woman according to the invention.
Figure 3:
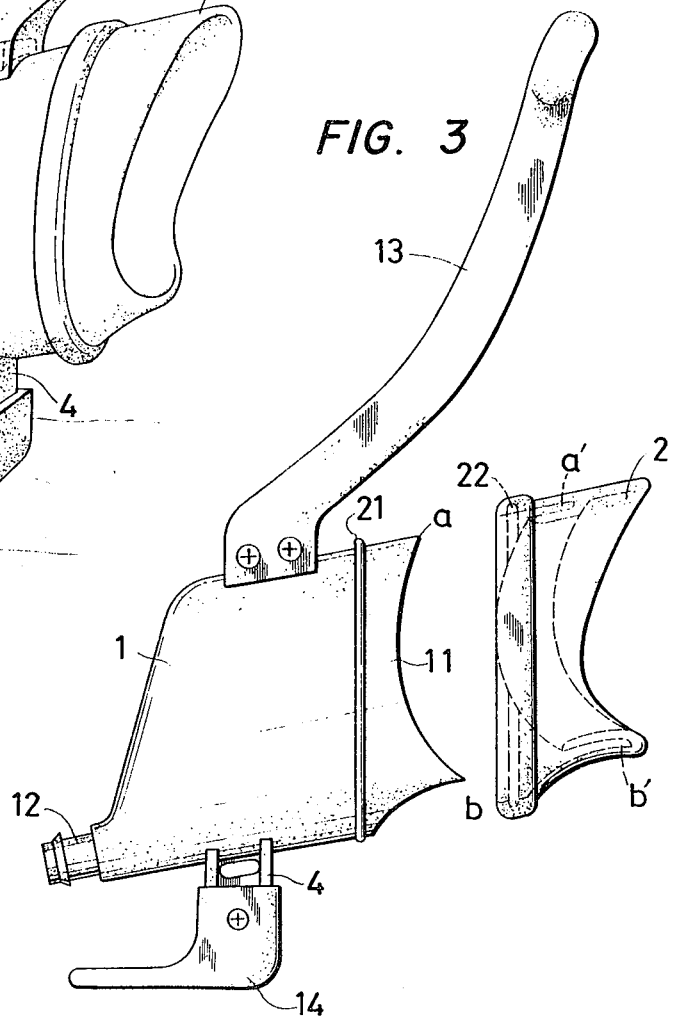
FIG. 3 is a side view showing the urinating receiver for a woman from which the contact frame has been removed.

Referring to the drawings, FIG. 1 is a schematic diagram illustrating the entire arrangement of a urinating device employing a urinating receiver according to the invention, The urinating receiver is mainly made up of a receiver body 1, a contact frame 2, and contact holding means 13 and 14. The receiver body is made of hard synthetic resin such as plastic. The contact frame is put on the front part of the cylindrical receiver body. The rear part of the body is closed except for the bottom portion where a protruding pipe 12 is provided. The pipe 12 is connected to a urine storing tank 300 through a urine discharging hose 400. The contact frame 2 is made of an elastic and flexible material such as rubber, and is shaped to be detachably secured to the front opening part 11 of the receiver body 1. Accordingly, in a urinating receiver for a woman, as shown in FIGS. 2 and 3, the section of the body is an elongated circle, and the section of the protruding front opening part is an arc, and furthermore the upper edge *a* is shorter than the lower edge *b.* The contact frame is provided with two recessed portion *a'* and *b'* along its inner wall so that the protruding front opening part 11 may be inserted thereinto; however, the recessed portions *a'* and *b'* are so dimensioned that the edges *a* and *b* do not reach the end of the contact frame. Therefore, tight contact is achieved when the frame is assembled to the body, also owing to the elasticity of the rubber.

Figure 5:
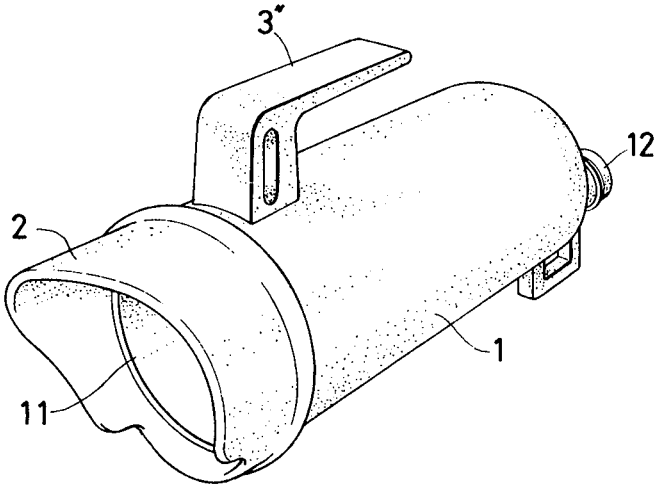
FIG. 5 is a perspective view illustrating a urinating receiver for a man according to the invention.

In a urinating receiver a for man, as shown in FIG. 5, the body 1 is cylindrical and the contact frame is also cylindrical. The front edge of the contact frame is gradually sloped downward so that it can come into close contact with the circumferential area of the base of the penis. In both cases described above, it is preferable in order to strongly fit and retain the contact frame onto the receiver body 2 to provide an annular engaging projection 21 on the outer wall of the body near its front opening part and to provide a mating annular groove 22 on the inner wall of the contact frame 2, such that the projection 21 is engaged with the groove 22 (FIGS. 6 and 7) in a snap-fit manner.

With the urinating receiver formed as described above, if a person passes his urine thereinto the contact frame 2 serves to introduce the urine into the rear part of the body 1. The frame 2 is so shaped that the recess on its inner wall is positioned more outwardly at the base of the frame, whereby placing the frame in contact with the circumferential area of the vagina causes no discomfort. Since the material of the frame is elastic and flexible, it can be readily and positively fitted closely around the private parts of women having different physical configurations, thereby preventing the leakage of urine. In addition, the contact frame 2 can be readily removed from the body 1, whereby cleaning and disinfecting can be readily achieved.

Figure 4:
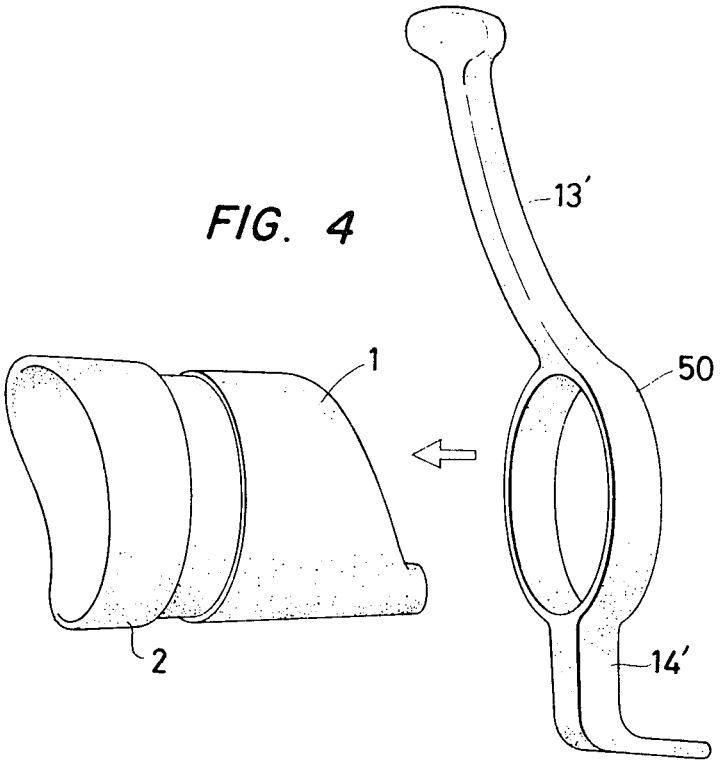
FIG. 4 is a perspective view illustrating another example of a urinating receiver for a woman.
Figure 6:
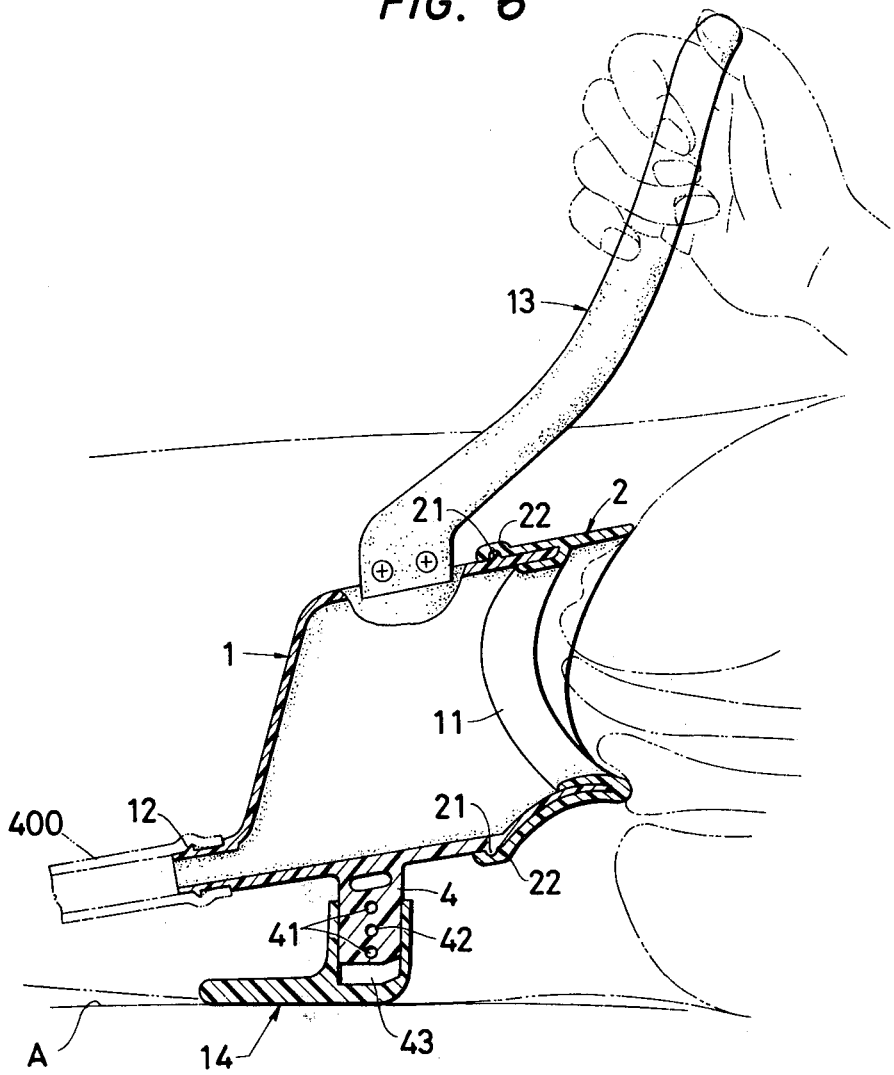
FIG. 6 is a sectional view of the urinating receiver for a woman shown in FIG. 2 in use.

In a urinating receiver shown in FIGS. 2 and 6, a handle 13 and a supporting base 14 are fastened to the protruding parts 3 and 4. When the urinating receiver is used, the supporting base 14 is placed, for instance, on a bed A by gripping the handle 14 with the hand, and the supporting base and receiver is slid along the bed toward the user by pulling the handle 13, as a result of which the front edge of the contact frame is placed in close contact with the users body. Whenever the urinating receiver is used, the front edge of the contact frame is fitted around the private parts in the same manner. Accordingly, the user can suitably pass urine into the receiver whether she is sitting down, or lying on her back or side. Therefore, the assistance of another person is not necessary for her to urinate. In the embodiment shown in FIG. 4, the handle 13' and the supporting base 14' may be connected together with a ring 50 which is firmly slipped over the body 1.

Referring to FIG. 6, a plurality of threaded holes 41 are provided at certain intervals in the member 4 protruding from the lower surface of the receiver body, while a sliding hole 43 is provided in the vertical part of the supporting base 14 so that the member 4 can be slidably inserted thereinto. The vertical part of the supporting base has holes at the positions corresponding to those of the threaded holes 41 so that screws 42 can be inserted therethrough. Thus, the urinating receiver is so designed that its height can be optimally selected in accordance with the position of the user (sitting down, or lying on her back or side) or in accordance with the user's physical configuration and/or the position of her meatus urinarius.

Figure 7:
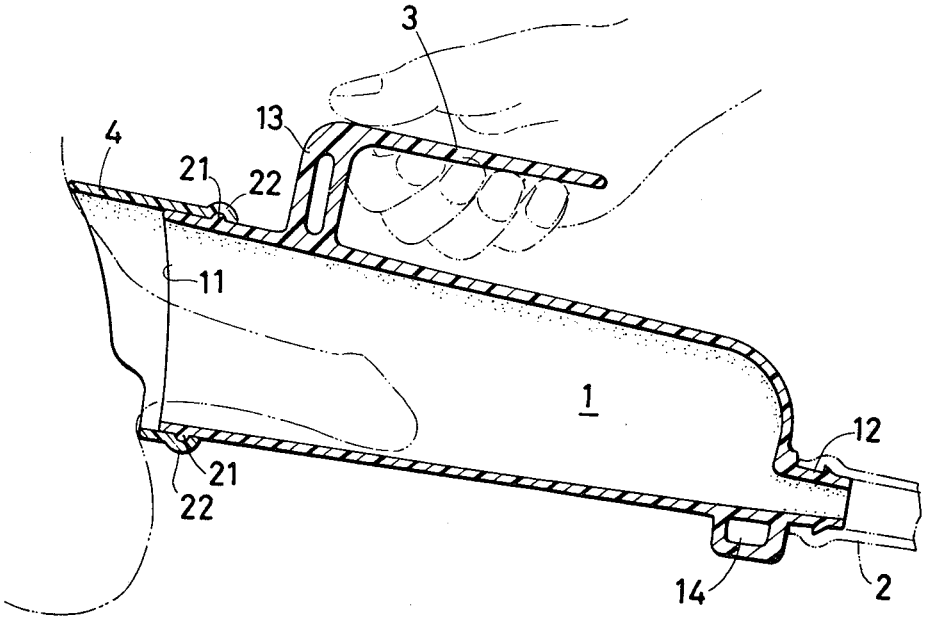
FIG. 7 is a sectional view of the urinating receiver for a man shown in FIG. 5 in use.

FIG. 7 illustrates a urinating receiver for a man in use.

Figure 8:
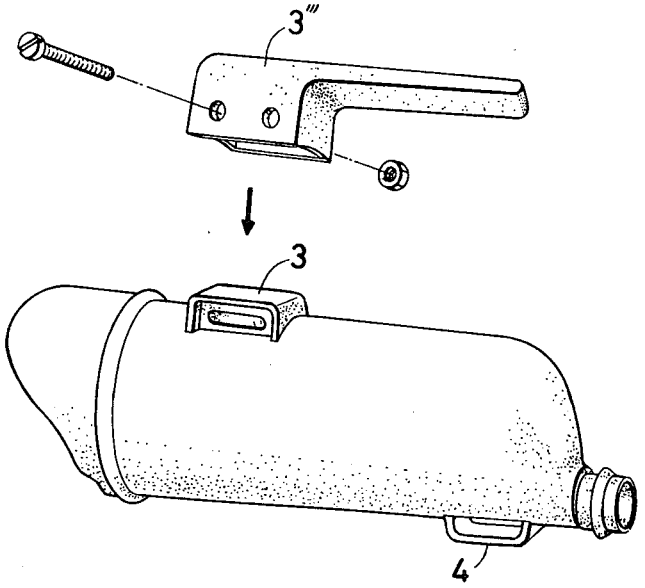
FIG. 8 is an exploded perspective view illustrating the handle mounting of the urinating receiver shown in FIG. 5.

FIG. 8 shows another example of a handle member 13" constituting the contact holding means of the urinating receiver for a man. The handle member has an L-shape and is fastened to the upper protruding member 3 with bolts or the like.

Figure 9:
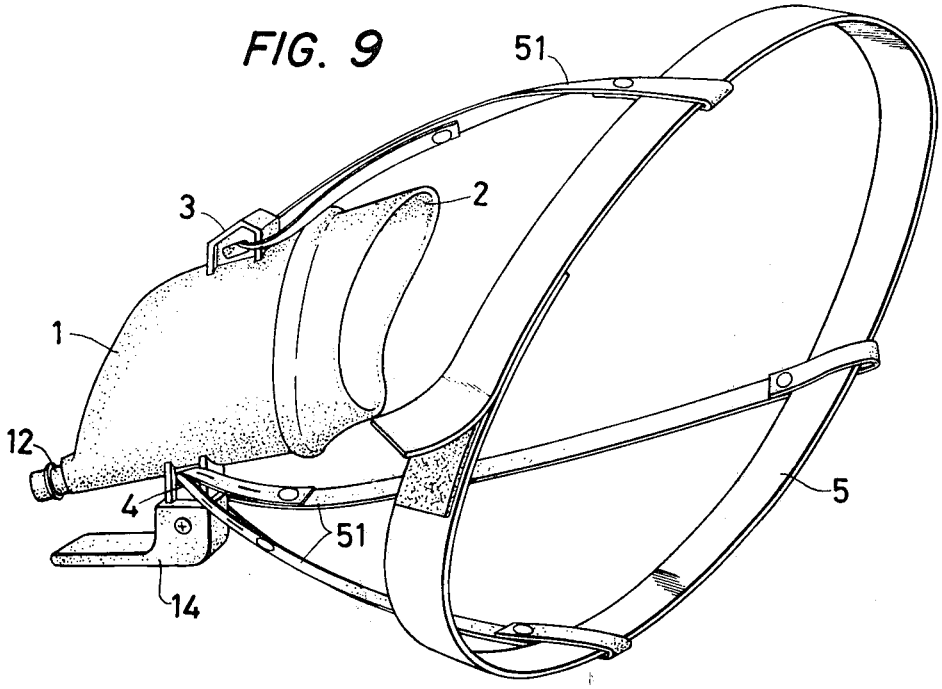
FIG. 9 is a perspective view showing another example of a urinating receiver body according to the invention with a known fastening belt.

FIG. 9 shows another embodiment of contact holding means. In this example, garter-like belts 51 hang in the form of the letter "T" from a waist belt 5 and are passed through the holes in the protruding parts 3 and 4 formed on the upper and lower surfaces of the body 1, respectively. The supporting base 14 is also fastened to the lower part 4, although the urinating receiver may also be used without the base 14. The receiver body 1 is pulled toward the user with the bolt 5 and the garter-like belts 51, and the contact frame 2 is tightly abutted abainst the users body by tightening the belt 5 around the waist. Thus, the user can urinate comfortably without another person's assistance. Since the contact frame 2 fits tightly the user feels no discomfort and the device causes no psychological burden, and the leakage of urine is completely prevented.

Figure 10:
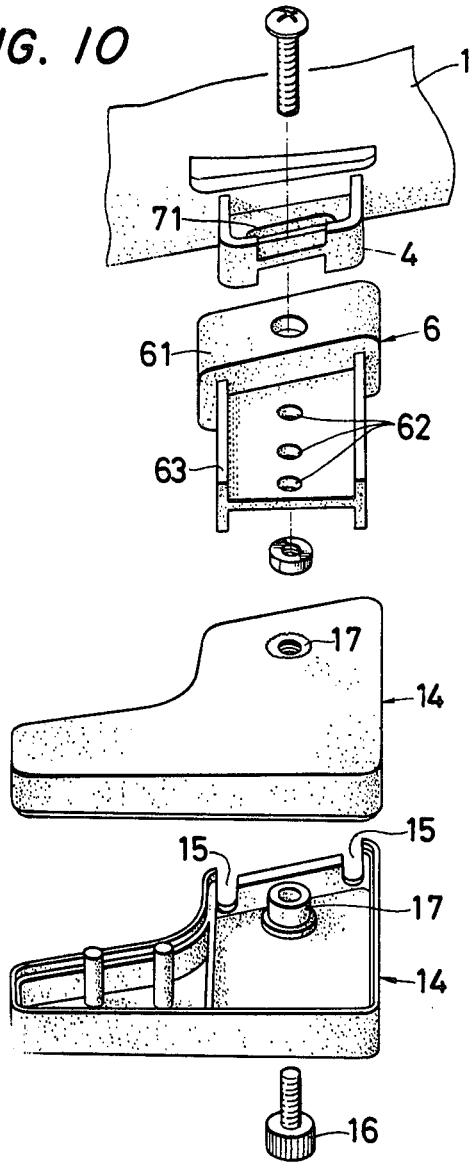
FIG. 10 is an exploded view of the construction and assembly of an adapter fastened to the urinating receiver according to the invention.
Figure 12:
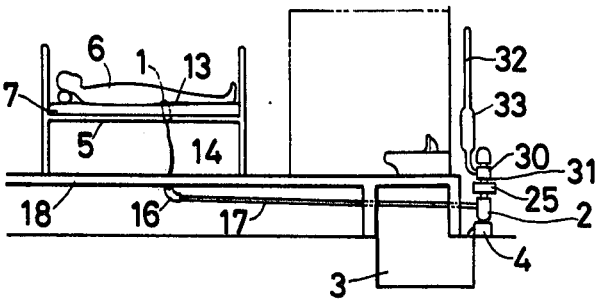
FIG. 12 is a schematic diagram illustrating the arrangement of a conventional urinating device.

FIG. 10 illustrates an embodiment in which an adapter 6 is connected to the protruding part 4 on the lower surface of the receiver body. The upper end portion of the T-shaped adapter is formed as a crown lid 61 for the part 4, while the lower portion is a leg bar 63 having an H-section. The leg bar 63 has threaded holes 62 for adjusting the height of the urinating receiver. The supporting base 14 has slots 15 inside the vertical post thereof into which the leg bar 63 of the adapter 6 is slidably inserted. The supporting base 14 is further provided with a hole 17 so that a screw 16 can be inserted into the hole 17 and a preselected hole 62 when the leg bar has been inserted into the supporting base. Accordingly, the height of the urinating receiver can be optimally adjusted to the user's physical configuration over a wide range.

Figure 11:
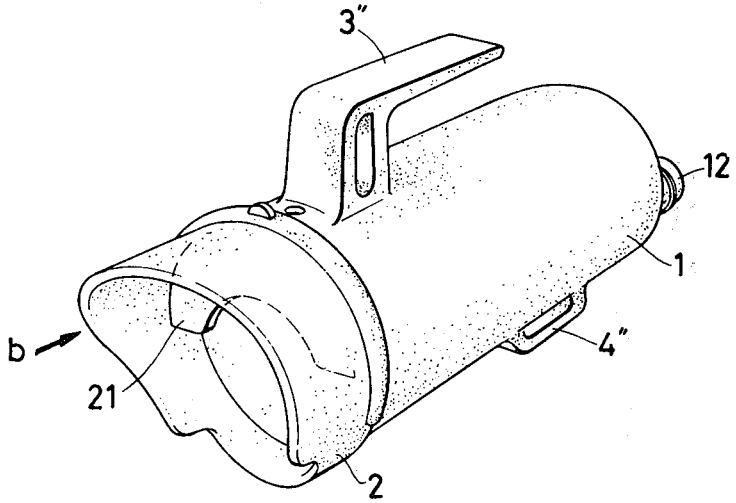
FIG. 11 is a perspective view showing another example of the urinating receiver for a man according to the invention.

FIG. 11 shows another embodiment of a urinating receiver for a man. The base of the contact frame 2 is detachably secured to the open end of the receiver body 1, and the front edge of the contact frame is gradually sloped so as to come closely into contact with the circumferential area of a penis. A semi-arc-shaped penis controlling plate 21 protrudes downwardly from the upper part of the inner wall of the cylindrical frame 2 in such a manner that it divides the frame into two parts at its cross-sectional plane slightly behind the front edge thereof. With a penis inserted into the frame and the front edge of the frame placed in contact with the circumferential area of the penis, urination can be readily achieved.

What is claimed is:

1. A urinating receiver comprising: a receiver body having an open front end and a closed rear end, a connecting pipe for connecting said receiver body to a urine storing tank through a urine discharge pipe protruding from the lower portion of said rear end; a contact frame made of elastic material, said contact frame having a base end detachably secured to the front end of said receiver body, and a front end recessed in the form of a curve; and holding and positioning means secured to said receiver body for placing said frame in contact with the circumferential area of a sexual organ.

2. A urinating receiver as claimed in claim 1, wherein said receiver body has an elongated configuration and an elongated, generally circular section, said front end of said receiver body has a protruding portion having an arc-shaped section, said base end of said contact frame has an arc-shaped recess into which said protruding portion of said receiver body is inserted, and said recess gradually progresses outwardly towards the front end of the frame as it approaches the bottom portion thereof.

3. A urinating receiver as claimed in claim 1, wherein said receiver body has a circular section, said contact frame is cylindrical so as to fit over the front end of said receiver body, the front end of said contact frame being gradually sloped downward so as to fit in close contact with the circumferential area of the base of a penis, and wherein a semi-arc-shaped penis controlling plate protrudes downwardly from the upper part of the inner wall of said contact frame and is located slightly behind the front end of said contact frame, whereby said urinating receiver is adapted for a man.

4. A urinating receiver as claimed in claim 1, wherein said holding and positioning means comprises a handle member provided on the upper external surface of said receiver body, and a supporting base member provided on the lower external surface of said receiver body, said handle member and supporting base member being detachably mounted on respective upper and lower projection members protruding from said receiver body.

5. A urinating receiver as claimed in claim 1, wherein said holding and positioning means comprises a ring dimensioned to fit over the external surface of said receiver body, a handle member integral with the upper part of said ring, and a supporting base member integral with the lower part of said ring.

6. A urinating receiver as claimed in claim 4, wherein said supporting base member is mounted on said lower projection member with screws, and said lower projection member has a plurality of vertical holes therethrough to enable the adjustment of the height of said urinating receiver.

7. A urinating receiver as claimed in claim 1, wherein said holding and positioning means comprises a belt adapted to be worn around the waist of a user, and a plurality of garter-like straps are hung from the belt in a T-configuration, one of said straps being passed through a hole in said upper projection member, and others of said straps being passed through a hole in said lower projection member.

8. A urinating receiver as claimed in claim 4, wherein a height adjusting means is detachably provided between said supporting base member and said lower projection member.

9. A urinating receiver as claimed in claim 8, wherein said height adjusting means has a T-shape, the upper part thereof is a crown lid for said lower projection member, and a leg bar is integral with said crown lid, said leg bar having an H-section and having a plurality of threaded holes at predetermined intervals for adjusting the height of said urinating receiver.

10. A urinating receiver as claimed in claim 3, wherein said holding and positioning means comprises a handle member having an L-shaped profile detachably mounted on said upper projection member.

11. A urinating receiver as claimed in claim 3, wherein said upper projection member has an L-shaped profile and serves as said holding and positioning means.

12. A urinating receiver as claimed in claim 1, wherein the external surface of said receiver body has a projecting rib near the front end thereof, and the base end of said contact frame has an annular recess for engaging said rib.

* * * * *